US005440204A

United States Patent [19]

Shih

[11] Patent Number: 5,440,204

[45] Date of Patent: Aug. 8, 1995

[54] GAS DISCHARGE LAMP LIGHTING SYSTEM WITH PHASE SYNCHRONIZED GATING OF D.C. ELECTRODE VOLTAGE

[75] Inventor: James C. Shih, Arlington Heights, Ill.

[73] Assignee: Intermatic Incorporated, Spring Grove, Ill.

[21] Appl. No.: 76,621

[22] Filed: Jun. 14, 1993

[51] Int. Cl.[6] ..... H05B 39/00

[52] U.S. Cl. ..... 315/94; 315/101; 315/106; 315/107; 315/DIG. 5; 315/DIG. 7

[58] Field of Search ..... 315/94, 106, 107, 160, 315/101, 86, 209, 273, DIG. 5, DIG. 7

[56] References Cited

U.S. PATENT DOCUMENTS

| | | | |
|---|---|---|---|
| 2,581,959 | 1/1952 | Koehler | 315/100 |
| 2,610,310 | 9/1952 | Miles | 315/100 |
| 3,248,533 | 4/1966 | Mathis | 240/51.1 |
| 3,539,861 | 11/1970 | Blackford | 315/118 |
| 3,665,243 | 5/1972 | Kaneda et al. | 315/101 |
| 3,746,921 | 7/1973 | Marshall et al. | 315/246 |
| 4,143,302 | 3/1979 | Weisner | 315/205 |
| 4,323,824 | 4/1982 | Roche et al. | 315/289 |
| 4,349,768 | 9/1982 | Miller | 315/105 |
| 4,451,767 | 5/1984 | Gorainik | 315/309 |
| 4,737,895 | 4/1988 | Silver | 362/225 |
| 4,789,810 | 12/1988 | Ottenstein | 315/308 |
| 4,795,945 | 1/1989 | Mayer | 315/106 |
| 5,013,970 | 5/1991 | Crawford | 315/106 |
| 5,021,714 | 6/1991 | Swanson et al. | 315/101 |
| 5,049,788 | 9/1991 | Lee | 315/219 |
| 5,130,605 | 7/1992 | Ogawa et al. | 315/105 |
| 5,132,595 | 7/1992 | Kulka et al. | 315/106 |

*Primary Examiner*—Robert J. Pascal
*Assistant Examiner*—Reginald A. Ratliff
*Attorney, Agent, or Firm*—Willian Brinks Hofer Gilson & Lione

[57] ABSTRACT

The present invention relates to a gas discharge lamp lighting system in which a voltage source is provided for supplying an a.c. voltage across the lamp electrodes and, further, a source of stored d.c. voltage which is gated to the electrodes in synchronism with and additive to the a.c. voltage, in order to provide a resultant voltage across the electrodes of a magnitude sufficient to light the lamp.

10 Claims, 1 Drawing Sheet

GAS DISCHARGE LAMP LIGHTING SYSTEM WITH PHASE SYNCHRONIZED GATING OF D.C. ELECTRODE VOLTAGE

BACKGROUND OF THE INVENTION

1. Field of the Invention

The present invention relates in general to gas discharge lamp lighting systems and, in particular, devices for starting such lamps.

2. Description of the Prior Art

Conventional starting devices for gas discharge lamps such as fluorescent lamps typically include mechanical starting devices which include bimetallic switches operative to control the flow of current through filaments or cathodes of the lamps. As is well known in the art, current flow through such starting devices causes them to open a circuit which includes a transformer ballast. When the circuit is open, a voltage is induced across the ballast, and this ballast voltage is added to the a.c. line voltage in order to provide a starting voltage across the electrodes of the lamp.

However, such conventional systems have certain drawbacks. First of all, because the starter is thermally actuated, there is no means for synchronizing the ballast voltage with the line voltage. The maximum current through the ballast occurs when the a.c. voltage is zero. As a result, the a.c. voltage and the ballast voltage are ninety degrees out of phase when they are added. Further, because there is no means for synchronizing the ballast voltage with the line voltage, such starters will only randomly maximize the starting voltage. Thus, the lamp may require several starter operations before ignition.

Another problem with conventional gas discharge or fluorescent lamps is that the reduced temperatures found in outdoor applications cause a corresponding reduction in gas pressure inside the lamp. This requires higher striking or igniting voltages to ignite or start the lamp.

Still another problem with conventional lighting fixtures is the control of preheat current. In particular, many preheat type lamps do not properly turn off the preheat current after ignition of the lamp. This can cause damage to the filaments and decrease the useful life of the lamp.

Some devices known in the prior art have attempted to overcome these problems. For example, high frequency electronic ballast circuits have been provided to start fluorescent lamps in cold ambient temperatures. However, such circuits typically generate high radio frequency signals which can interfere with radio frequency transmission and reception. Attempts have been made to eliminate such radio frequency interference by grounding and shielding such circuits, but this approach requires additional expense and is sometimes unsatisfactory.

SUMMARY OF THE INVENTION

The present invention is directed to an efficient gas discharge lamp lighting system which includes circuitry for providing adequate and reliable starting of the lamps even under a wide variety of ambient conditions and in which the generation of undesirable radio frequency interference can be avoided.

In general, the present invention includes a gas discharge lamp lighting system in which a voltage source is provided for supplying an a.c. voltage across the lamp electrodes and, further, a source of stored d.c. voltage which is gated to the electrodes in synchronism with and additive to the a.c. voltage, in order to provide a resultant voltage across the electrodes of a magnitude sufficient to light the lamp.

Another aspect of the present invention is directed to starting a gas discharge lamp of the preheat type in which a heater is provided for each of the lamp electrodes. A heater circuit supplies current to the heaters to preheat the lamp just before the stored d.c. voltage is gated to the electrodes in synchronism with the a.c. voltage. In order to prevent damage to the electrode heaters after the lamp is ignited, the heater circuit terminates the current to the heaters after the lamp is ignited.

The present invention, together with its attendant features, objects and advantages, will be best understood with reference to the detailed description below which, when read in conjunction with the accompanying drawing discloses a presently preferred embodiment of the invention.

DETAILED DESCRIPTION OF THE PRESENTLY PREFERRED EMBODIMENT

Figure 1:
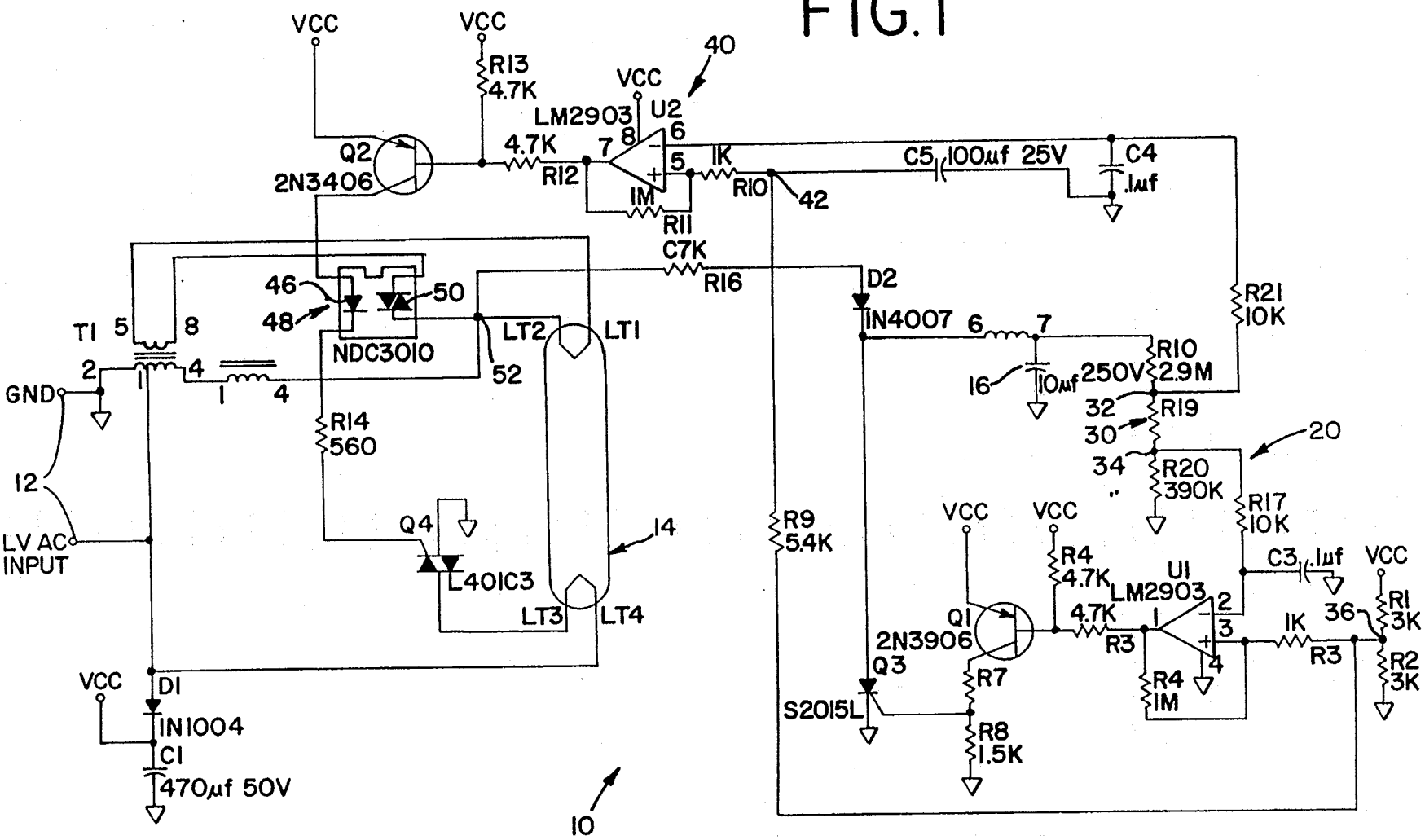
FIGURE 1 is a schematic diagram illustrating the presently preferred embodiment of the present invention.

FIGURE 1 illustrates a presently preferred embodiment of a gas discharge lamp lighting system according to the present invention adapted for use with a gas discharge lamp such as a conventional fluorescent lamp of the preheat type commonly designated as an F6T5 lamp. However, many other lamps having a wide variety of characteristics may be used including non-preheat type lamps. In FIGURE 1, the conventional components and values suitable for use in the presently preferred embodiment are indicated.

The circuit 10 is supplied by a conventional low voltage (9–12 volts) and low frequency (60 HZ) power supply 12. Of course, it should be recognized that a power source having a larger voltage may also be used. The power supply 12 provides a source of a.c. voltage to fluorescent lamp 14 through an autotransformer T1 which is connected in series with the secondary of a transformer T2 for a purpose to be described.

The power supply 12 is also connected to a diode D1 and a capacitor C1 to provide a d.c. voltage VCC for supplying the active components of the circuit 10. The VCC voltage is rapidly produced after the power supply 12 is turned on. In the preferred embodiment, VCC is approximately 16 volts.

The autotransformer T1 provides an a.c. voltage across the electrodes of the fluorescent lamp 14. However, the voltage supplied by the autotransformer T1 may not be sufficient to ignite or start the fluorescent lamp 14 under all conditions, particularly in low ambient temperatures. For this purpose, a supplemental voltage is generated, in a manner to be described, across the secondary of a transformer T2. This supplemental voltage is synchronized with, and is additive to, the voltage developed across the primary of autotransformer T1. The resultant (T1 plus T2) voltage across electrodes LT1/LT2 and LT3/LT4 of the lamp 14 will usually be sufficient to start the lamp 14 under almost all ambient conditions.

The circuit 10 includes a source of stored d.c. voltage such as capacitor C2 16. This capacitor is charged through R16, D2 and the primary of transformer T2. Circuit 20 is provided for controlling or gating the discharge of capacitor C2 to generate a high-current pulse of short duration through the primary of T2. This current pulse will induce across the secondary of T2 a high voltage which is additive to, and synchronized with, that is, in phase with, the a.c. voltage developed across T1. The primary to secondary turns ratio of T2 is preferably between 20 to 30. Moreover, once the lamp 14 is started, the secondary of T2 also acts as a ballast to limit the flow of current to the lamp 14.

Circuit 20 controls the timing of the current pulse through the primary of T2. Circuit 20 includes a voltage comparator U1. A voltage divider 30 includes resistors R18, R19 and R20 connected in series. The voltage divider 30 is connected in parallel with C2 with the result that voltage is developed across the voltage divider 30 as C2 charges. Node 32 connects resistor R18 to resistor R19, and node 34 connects resistor R19 to resistor R20, which is in turn connected to ground.

Voltage comparator U1 compares the voltage at node 34 at voltage divider 30 with the voltage at node 36, which is derived by another voltage divider comprising identical resistors R1 and R2. The voltage at node 36 is one-half the voltage of VCC. When the voltage at node 34 exceeds the voltage on node 36, the output of voltage comparator U1 drops and, as a result, turns a transistor Q1 on, which thereby gates SCR Q3. When SCR Q3 is conductive, the energy stored in charged capacitor C2 discharges through R8 to ground, thereby inducing a large current pulse through the primary of T2. This large current flows through Q3, but Q3 is not damaged because the current is of short duration. C2 discharges to automatically develop a voltage across the secondary of T2 in synchronism with, that is, in phase with, the voltage across T1 to provide a maximum starting voltage for the lamp 14. Further, because C2 is charged by current flowing in one direction through T2 and is discharged by current flowing in the opposite direction, the flux developed in T2 maximizes the magnitude of the supplemental or booster voltage for igniting the lamp 14.

Circuit 10 provides for heating the electrodes LT1/LT2 and LT3/LT4 or filaments by providing current through these electrodes. Because the lamp 14 is a preheat type lamp, it is desirable that the filaments be preheated before the capacitor C2 discharges. However, in order to prevent damage or bum-out to the filaments, the current through the filaments of lamp 14 should be terminated at a predetermined time, preferably just after the lamp 14 is lit. Once the lamp 14 is started, filament current or heater current is no longer required, and continued heater current may damage the lamp filaments.

The timing of the lamp preheat function is controlled by voltage comparator U2 and its associated circuitry, which are generally designated by reference numeral 40. Voltage comparator U2 has a negative input connected through R21 to a node 32 of the voltage divider 30. The positive input of the voltage comparator U2 is connected through a resistor R10 to a node 42. Node 42 is in turn connected to ground to a capacitor C5 and to node 36 through a resistor R9. A capacitor C4 is connected in parallel to the negative input of the voltage comparator U2 and capacitor C5.

Capacitor C5 charges to one-half the value of VCC (developed across the voltage divider comprising resistors R1 and R2 as previously stated) after a certain time constant which is determined by the value of C5. When VCC is first applied to the circuit 10, the output at pin 7 of voltage comparator U2 is low, turning transistor Q2 on. When Q2 is on, current flows through a diode 46 of an opto-isolator 48 and through a current-limiting resistor R14, thereby gating triac Q4, and providing current through the filament LT3/LT4 of lamp 14.

Opto-isolator 48 also comprises a triac 50 which is gated when current flows through diode 46. The gating of triac 50 causes current to flow through the filament LT1/LT2 of fluorescent lamp 14. The supply to the filament LT1/LT2 is floating, and the opto-isolator 48 controls the energization of filament LT1/LT2 as it is isolated from the rest of the circuit.

Once the lamp 14 is fired, the voltage on node 42 reaches one-half the voltage VCC as the capacitor C5 is charged. When this occurs, voltage comparator U2 no longer drives the transistor Q2. This turns off the supply to the filaments or heaters LT1/LT2 and LT3/LT4. Once the lamp 14 is started, the voltage on node 52 is clamped to a relative low value due to the relatively low impedance across the electrodes of the lamp 14. Capacitor C2 charges, but to a relatively low voltage on the order of 50 volts with the indicated components. As a result, the voltage at nodes 32 and 34 of voltage divider 30 is relatively low, and voltage comparators U1 and U2 turn off Q1 and Q2, respectively.

It is expected that the circuit 10 will provide a sufficiently high voltage to start the lamp 14 under almost all conditions. It should be recognized that once the lamp 14 is started, the voltage at node 32 will be less than the value of one-half VCC in order to shut off the preheating current to the filaments LT1/LT2 and LT3/LT4 of lamp 14. Further, any time the voltage at node 34 is greater than the magnitude of one-half VCC, voltage comparator U1 will turn transistor Q1 on to discharge capacitor C2. Thus, if the lamp 14 fails to ignite, the circuit 10 will repeat its operation until the lamp 14 is started.

When the a.c. power supply 12 is turned off, capacitors C1 and C2 will discharge. However, capacitor C1 will discharge at a much higher rate than capacitor C2, which discharges through the relatively high resistances which comprise voltage divider 30. As a result, the voltages VCC and therefore one-half VCC drop relatively quickly in comparison to the voltages derived by the voltage divider 30, causing voltage comparators U1 and U2 to once again turn on transistors Q1 and Q2, respectively. The turn-on operation of Q1 results in the complete discharge of C2, which eliminates any potential safety hazard caused by a stored voltage in circuit 10. Of course, this last turn-on operation of Q2 has no effect on the supply to the filaments LT1/LT2 and LT3/LT4 of lamp 14 because the a.c. power is already off.

It will be appreciated that the circuit 10 does not require any voltage regulators, but uses linear components, including resistors. The circuit 10 is operative to start the lamp even if the a.c. supply voltage fluctuates or changes because corresponding voltage changes occur throughout the circuit.

The present embodiment is illustrative and not restrictive. The scope of the invention is indicated by the claims rather than by the foregoing description. The invention may be embodied in other specific forms without departing from the spirit of the invention. For example, the components of circuit 10 may be easily modified to meet the requirements of many different sizes and types of gas discharge lamps. Accordingly, all changes and departures which come within the meaning and range of the claims and their equivalents are intended to be covered.

I claim:

1. A gas discharge lamp lighting system comprising:

a gas discharge lamp having two electrodes;

a voltage source for supplying an a.c. voltage across said electrodes;

a source of stored d.c. voltage; and a circuit for gating said d.c. voltage to said electrodes phase synchronized with, and additive to, said a.c. voltage to provide a resultant voltage across said electrodes of a magnitude sufficient to light said lamp.

2. The gas discharge lighting system of claim 1 wherein said source of stored d.c. voltage comprises a capacitor, and said gating circuit is operable to discharge said capacitor.

3. The gas discharge lamp lighting system of claim 2 and a first transformer connected to said a.c. voltage source and said electrodes, said gating circuit comprising a second transformer connected in series with said first transformer.

4. A gas discharge lamp lighting system comprising:

a gas discharge lamp having two electrodes and a heater for each of said electrodes;

a heater circuit for supplying current to said heaters to preheat said lamp;

a voltage source for supplying an a.c. voltage across said electrodes;

a source of stored d.c. voltage; and a circuit for gating said d.c. voltage to said electrodes synchronized in phase with, and additive to, said a.c. voltage to provide a resultant voltage across said electrodes of a magnitude sufficient to light said lamp;

said heater circuit being operative to terminate said heater current after a predetermined time.

5. The gas discharge lamp lighting system of claim 4 wherein said heater circuit is operative to terminate said current to said heaters after said stored d.c. voltage is gated to said electrodes.

6. The gas discharge lighting system of claim 5 wherein said source of stored d.c. voltage comprises a capacitor, and said gating circuit is operable to discharge said capacitor.

7. The gas discharge lamp lighting system of claim 6 and a first transformer connected to said a.c. voltage source and said electrodes, said gating circuit comprising a second transformer connected in series with said first transformer.

8. A gas discharge lamp lighting system comprising:

a gas discharge lamp having two electrodes and a heater for each of said electrodes;

a heater circuit for supplying current to said heaters to preheat said lamp;

a voltage source for supplying an a.c. voltage across said electrodes;

a capacitor charged by said a.c. voltage source for providing a source of stored d.c. voltage; and a circuit for gating said d.c. voltage to said electrodes phase synchronized with, and additive to, said a.c. voltage to provide a resultant voltage across said electrodes of a magnitude sufficient to light said lamp;

said heater circuit being operative to terminate said current to said heaters after said stored d.c. voltage is gated to said electrodes;

said heater circuit and said gating circuit being actuated in response to the presence of first and second control voltages, respectively, said control voltages being derived from a voltage on said capacitor, said first control voltage being timed in relation to said second control voltage in order to cause actuation of said heater circuit prior to actuation of said gating circuit to preheat said lamp before said resultant voltage is provided across said electrodes.

9. The gas discharge lamp lighting system of claim 8 wherein said heater circuit and said gating circuit comprise voltage comparator circuits having inputs comprising a reference voltage and said first and second control voltages, respectively.

10. The gas discharge lamp lighting system of claim 9 and a switching circuit controlled by each of said voltage comparator circuits.

* * * * *